US005959403A

United States Patent [19]

Lee

[11] Patent Number: 5,959,403

[45] Date of Patent: Sep. 28, 1999

[54] PLASMA DISPLAY PANEL WITH MAGNETIC PARTITION WALLS

[75] Inventor: Kyeong-Won Lee, Kyungki-do, Rep. of Korea

[73] Assignee: LG Electronics Inc., Seoul, Rep. of Korea

[21] Appl. No.: 08/947,469

[22] Filed: Oct. 9, 1997

[30] Foreign Application Priority Data

Oct. 9, 1996 [KR] Rep. of Korea ..... 96-44880
Dec. 31, 1996 [KR] Rep. of Korea ..... 96-80768

[51] Int. Cl.[6] ..... H01J 17/00

[52] U.S. Cl. ..... 313/590; 313/582; 313/584; 313/586; 313/587; 313/485; 313/156

[58] Field of Search ..... 313/582, 584, 313/586, 587, 485, 156

[56] References Cited

U.S. PATENT DOCUMENTS

| | | | |
|---|---|---|---|
| 3,989,981 | 11/1976 | Ogle et al. | 313/584 |
| 5,682,081 | 10/1997 | Reynolds | 313/582 |
| 5,717,292 | 2/1998 | Jin et al. | 313/582 |
| 5,734,221 | 3/1998 | Van Os | 313/113 |

FOREIGN PATENT DOCUMENTS

| | | | |
|---|---|---|---|
| 4-4543 | 1/1992 | Japan | 313/582 |

*Primary Examiner*—Sandra O'Shea
*Assistant Examiner*—Ronald E. DelGizzi

[57] ABSTRACT

A plasma display panel includes a plurality of discharge cells formed with a plurality of partition walls arranged at fixed intervals between a front substrate and a rear substrate disposed in parallel spaced at a certain distance. A fluorescent material film is formed on a portion of an inside surface of each of the discharge cells. A discharge gas is sealed in each of the discharge cells and is converted into a plasma upon the occurrence of a discharge in each of the discharge cells. Each of the partition walls is formed with a stack of at least more than one permanent magnets magnetized with N and S poles for forming a magnetic field in the discharge cell. The electrons existing in the plasma are thus accelerated toward the fluorescent material film upon occurrence of a discharge in the discharge cell by the magnetic field such that the fluorescent material film can be excited, whereby a luminance of a panel screen can be improved, equal sized magnetic partition walls can be formed, and production time of the magnetic partition walls can be shortened.

20 Claims, 6 Drawing Sheets

PLASMA DISPLAY PANEL WITH MAGNETIC PARTITION WALLS

BACKGROUND OF THE INVENTION

1. Field of the Invention

The present invention relates to a PDP(Plasma Display Panel) and a method for fabricating the same, and more particularly, to a plasma display panel with magnetic partition walls and a method for fabricating the same.

2. Discussion of the Related Art

As a general kind of light emitting device for displaying an image using gaseous discharge within cells, the plasma display panel is being used as a rectangular large sized image display, particularly as an image display directed to the HDTV(High Definition TeleVision) because it requires a very simple fabrication process and is easy to fabricate as a large sized screen having a high response speed.

FIG. 1 illustrates a perspective view showing an overall view of a conventional three electrode surface-discharge color plasma display panel.

Referring to FIG. 1, the conventional three electrode surface-discharge color plasma display panel includes a front substrate 1 for displaying an image, a rear substrate 2 disposed spaced a certain distance apart from, and in parallel to the front substrate 1, a plurality of partition walls 3 arranged at fixed intervals on a surface of the rear substrate 2 facing the front substrate 1, and a plurality of discharge cells formed by the coupling of the front substrate 1 and the rear substrate 2. The conventional three electrode surface-discharge color plasma display panel further includes a plurality of address electrodes 4 each formed between every adjacent partition walls 3, a fluorescent material film 5 formed inside of each of the discharge cells on both walls of the partition walls 3 and one of the address electrodes 4 therein on the rear substrate 2 to cover the address electrode 4 for emitting a visible light at a discharge, and pluralities of first and second sustain electrodes 6 and 7 formed alternatively at fixed intervals on a surface of the front substrate 1 facing the rear substrate 2. The pluralities of first and second sustain electrodes 6 and 7 are formed vertical to the plurality of the address electrodes to divide the entire screen into the plurality of discharge cells. And, there is a dielectric film 8 formed on the pluralities of the first and second sustain electrodes 6 and 7 for blocking a discharge current, a protection film 9 formed on the dielectric film 8 for protecting the dielectric film 8 and the first and second sustain electrodes 6 and 7, and a discharge gas sealed in each of the discharge cells for inducing the penning effect.

Referring to FIG. 2, an image displaying process on one of the cells in the aforementioned conventional three electrode surface-discharge color plasma display panel will be explained.

Upon application of discharge initiating voltage to the first and second sustain electrodes 6 and 7, the first and second sustain electrodes 6 and 7 are caused to make a surface discharge between them to form a wall charge on inside walls of the discharge cell. Then, when the first sustain electrode 6 and the address electrode 4 have discharge voltage applied thereto to cause an address discharge between the first sustain electrode 6 and the address electrode 4, the discharge gas sealed in the discharge cell is ionized into electrons and ions into a plasma state. Ionized particles excited by collision in the plasma state emit ultra-violet rays that drop to a bottom level, which ultra-violet rays collide at the fluorescent material film 5 on the inside surface of the discharge cell to emit visible light that is presented to outside of the panel through the front substrate 1. Thereafter, when a discharge sustain voltage is applied to the first and second sustain electrodes 6 and 7 to cause a sustained discharge between them, the aforementioned address discharge is sustained.

However, the conventional plasma display panel has a problem in that large scale demand of these units can not be expected because luminance of a displayed image is significantly lower in comparison to well known image display devices, such as CRT(Cathode Ray Tube), LCD(Liquid Crystal Display) and the like.

SUMMARY OF THE INVENTION

Accordingly, the present invention is directed to a plasma display panel with magnetic partition walls and a method for fabricating the same that substantially obviates one or more of the problems due to limitations and disadvantages of the related art.

An object of the present invention is to provide a plasma display panel with magnetic partition walls of which a panel screen has improved luminance, and a method for fabricating the same.

Another object of the present invention is to provide a plasma display panel with magnetic partition walls which has equal sized partition walls, and a method for fabricating the same.

A further object of the present invention is to provide a plasma display panel with magnetic partition walls which can be made with improved productivity, and a method for fabricating the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims as well as the appended drawings.

To achieve these and other advantages and in accordance with the purpose of the present invention, as embodied and broadly described, the plasma display panel with magnetic partition walls has each of the magnetic partition walls formed with permanent magnets magnetized into at least more than one N and S pole pairs for sustained formation of magnetic fields in each of discharge cells.

The plasma display panel with magnetic partition walls of the present invention has a rear substrate formed with permanent magnets magnetized into at least more than one N and S pole pair for sustained formation of magnetic fields in each of discharge cells.

The plasma display panel with magnetic partition walls of the present invention has the magnetic partition walls and a rear substrate, each formed with permanent magnets magnetized into at least more than one N and S pole pair for sustained formation of magnetic fields in each of discharge cells.

The plasma display panel with magnetic partition walls of the present invention has permanent magnets which form the magnetic partition walls and a rear substrate each including a stack of layers of magnetic films containing a plurality of acicular magnetic particles for improving an efficiency of a magnetic field.

According to another aspect of the present invention, there is provided a method for fabricating magnetic partition walls in a plasma display panel, the magnetic partition walls being formed arranged between a front substrate and a rear substrate of the plasma display panel, including the steps of coating a partition material having magnetic material particles mixed therewith on an entire surface of the rear substrate to form a partition material layer to a thickness required for a height of the magnetic partition walls, applying an external magnetic field to the partition wall material layer vertical to the rear substrate to magnetize the partition wall material layer, forming masks at positions on an upper surface of the partition wall material layer where a plurality of magnetic partition walls are to be formed, conducting sandblasting for removing portions of the partition wall material layer having no masks formed thereon, and removing all the masks and baking the partition wall material layer remaining on the rear substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention, wherein.

DETAILED DESCRIPTION OF THE PREFERRED EMBODIMENT

Reference will now be made in detail to the preferred embodiments of the present invention, examples of which are illustrated in the accompanying drawings.

FIRST EMBODIMENT

Figure 1:
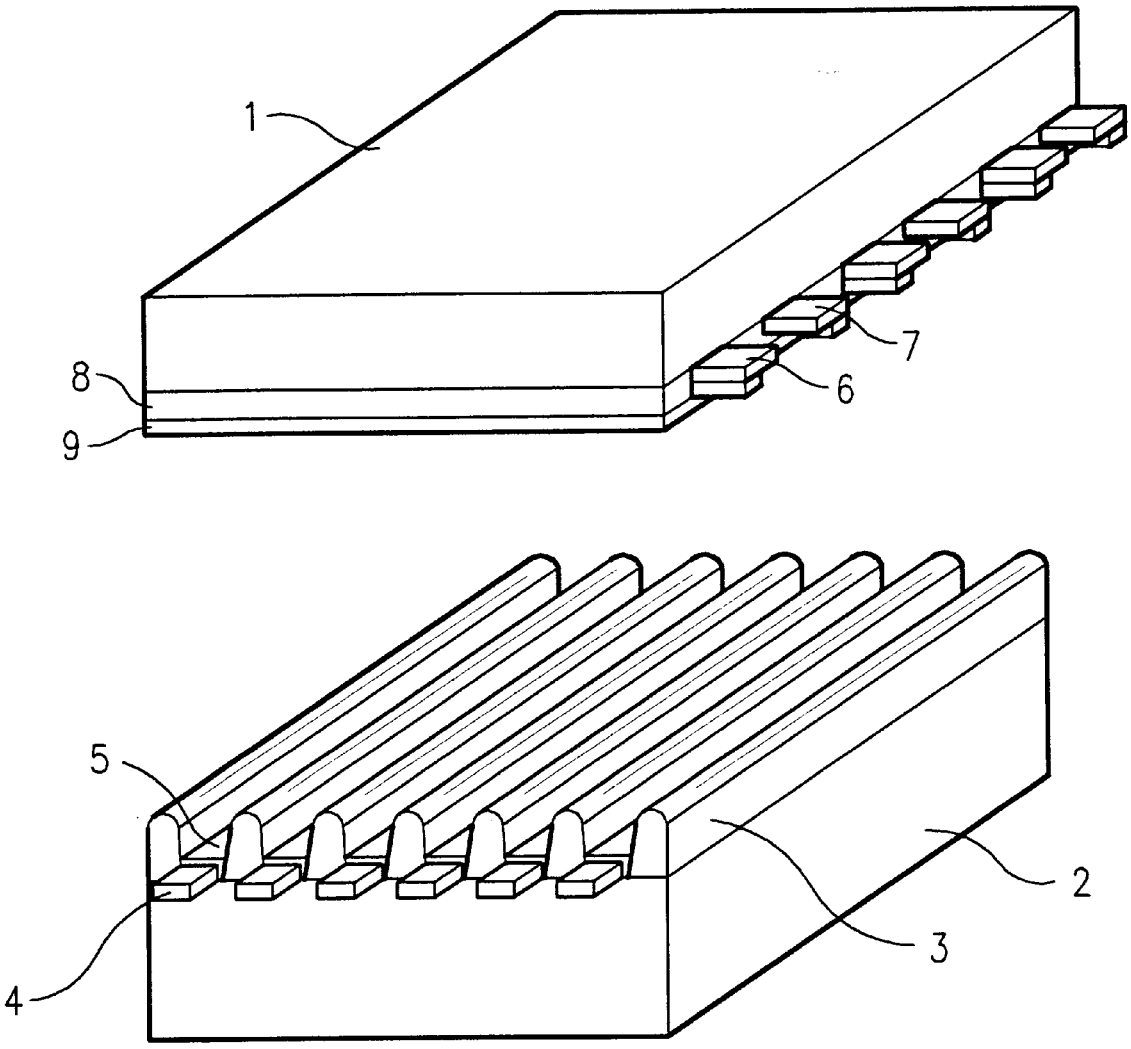
FIG.1 prior art
FIG. 1 illustrates a perspective view showing an overall view of a conventional three electrode surface-discharge color plasma display panel.
Figure 2:
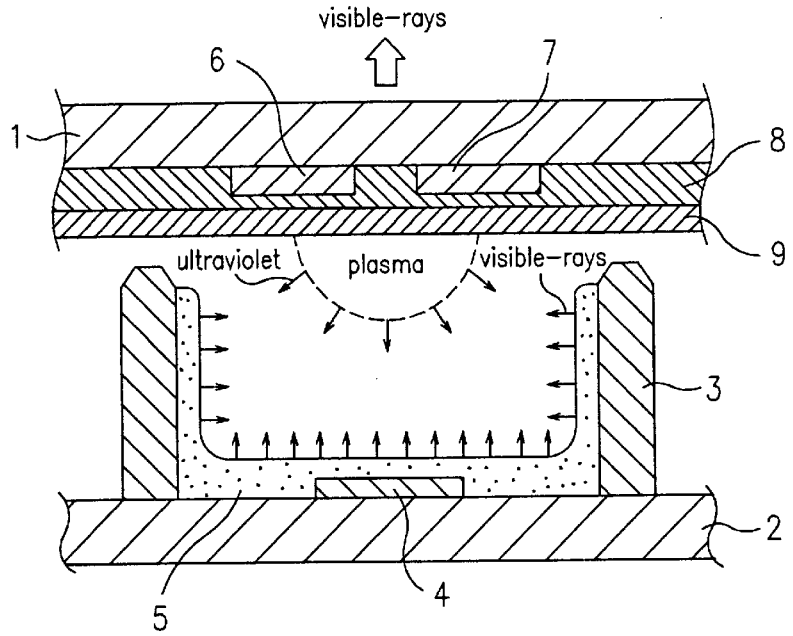
FIG.2 prior art
FIG. 2 illustrates a section of one of the discharge cells shown in FIG. 1.
Figure 3:
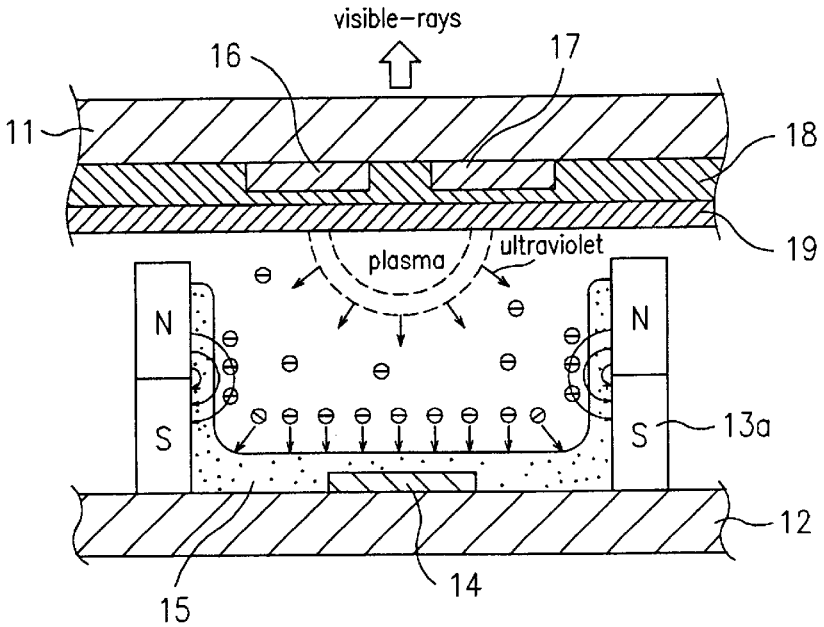
FIG. 3 illustrates a section of a plasma display panel with magnetic partition walls in accordance with a first embodiment of the present invention.
Figure 4:
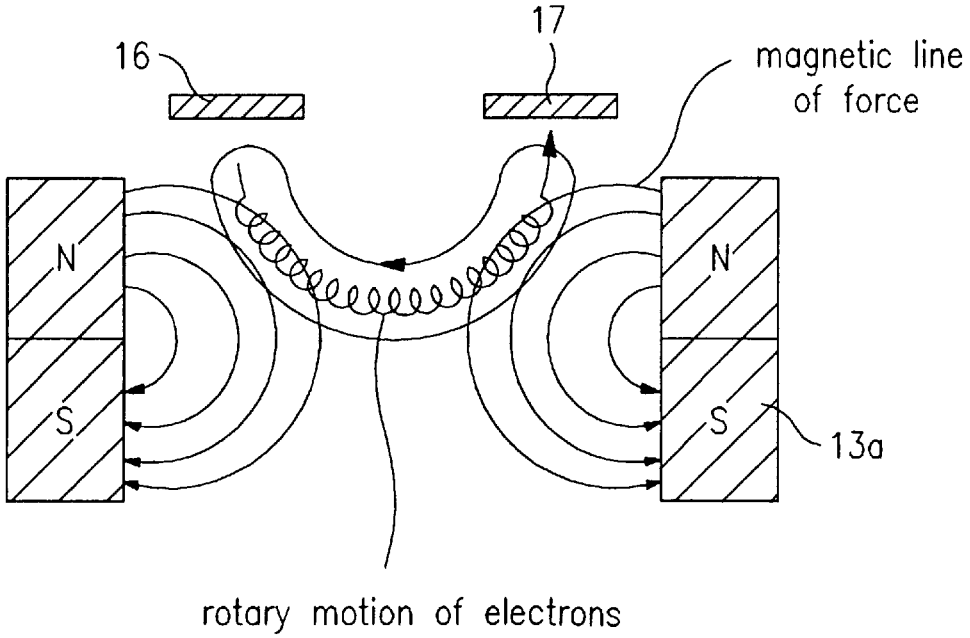
FIG. 4 illustrates rotation of an electron occurring in each of the cells in the plasma display panel shown in FIG. 3.

FIG. 3 illustrates a section of a plasma display panel with magnetic partition walls in accordance with a first embodiment of the present invention, FIG. 4 illustrates rotation of an electron occurring in each of the cells in the plasma display panel shown in FIG. 3, and FIGS. 5A~5E illustrate sections showing process steps of a method for fabricating magnetic partition walls in a plasma display panel in accordance with present invention.

Referring to FIG. 3, the plasma display panel with magnetic partition walls in accordance with a first embodiment of the present invention includes a front substrate 11, a rear substrate 12, partition walls 13*a*, a pair of a first, and a second sustain electrodes 16 and 17, an address electrode 14, a fluorescent material film 15, a dielectric film 18, and an MgO protection film 19. However, different from the conventional three electrode surface-discharge plasma display panel, each of the partition walls 13*a* is formed with magnets each magnetized either as N or S poles.

Referring to FIG. 4, in each of the discharge cells in the aforementioned plasma display panel, the electrons, moving along an electric field formed between the first and second sustain electrodes 16 and 17, are caused to rotate because of magnetic fields formed by the magnetic walls in directions shown by arrows, enhancing collision of the electrons with neutral particles of a penning gas, promoting ionization of the neutral particles to emit more ultraviolet rays required for excitation of the fluorescent material film 15, thereby the luminance of the screen becomes higher because of the higher excitation of the fluorescent material film 15. The electrons are rotated according to the principle that a charged particle incident to a magnetic field is made to rotate in a direction vertical to the magnetic field.

A preferred embodiment of a method for fabricating the aforementioned plasma display panel with partition walls of the present invention will be explained with reference to the attached drawings.

Figure 5A:
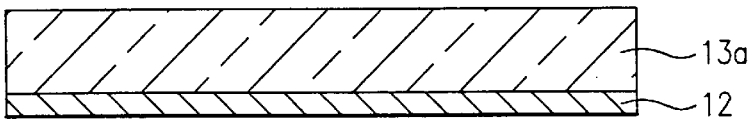
FIGS. 5A~5E illustrate sections showing process steps of a method for fabricating magnetic partition walls in a plasma display panel in accordance with present invention.
Figure 5B:
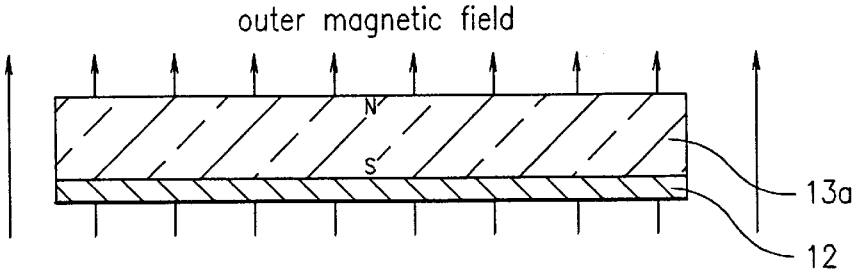
Figure 5C:
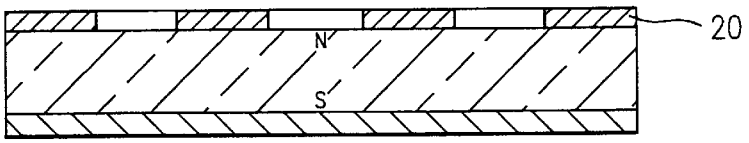
Figure 5D:
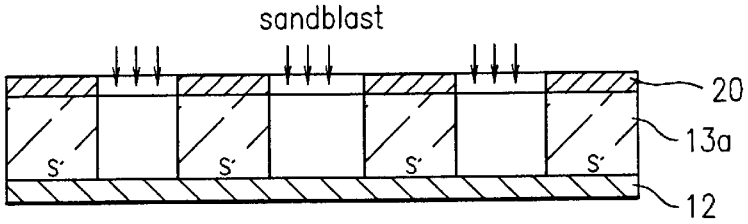
Figure 5E:
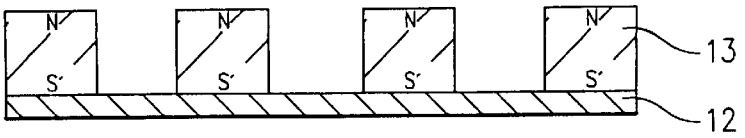

Referring to FIG. 5A, the method starts with coating a partition wall material mixed with magnetic material particles on one entire surface of the rear substrate 12, to form a partition wall material layer 13*a* of a thickness required for a height of the magnetic partition walls(step 1). As shown in FIG. 5B, a strong external magnetic field is applied to the partition wall material layer 13*a* in a direction vertical to the rear substrate 12(the direction shown with arrows in the drawing), to magnetize the partition wall material layer 13*a* into a magnet with N and S poles(step 2). That is, when the partition wall material layer 13*a* is exposed to a strong external magnetic field, the magnetic material particles in the partition wall material layer 13*a* become aligned in one direction, to magnetize the partition wall material layer 13*a* into a magnet with N and S poles. As shown in FIG. 5C, a mask 20 is formed at each of the positions on a surface of the partition wall material layer 13*a* in which a magnetic partition wall is to be formed(step 3). The masks 20 are of a photoresist pattern formed by photolithography. As shown in FIG. 5D, a sandblasting is conducted to remove portions of the partition wall material layer 13*a* having none of the masks 20 formed thereon(step 4). The sandblasting is a blasting of sand grains in a direction shown with arrows in FIG. 5D, removing portions of the partition wall material layer having none of the masks 20 formed thereon. As shown in FIG. 5E, after removing all the masks 20, the portions of the partition wall material layer which are equal sized and remaining on the rear substrate 12 are baked at a preset temperature, to complete formation of the plurality of magnetic partition walls 13*a* which are equal sized and magnetized with N and S poles(step 5).

SECOND EMBODIMENT

Figure 6A:
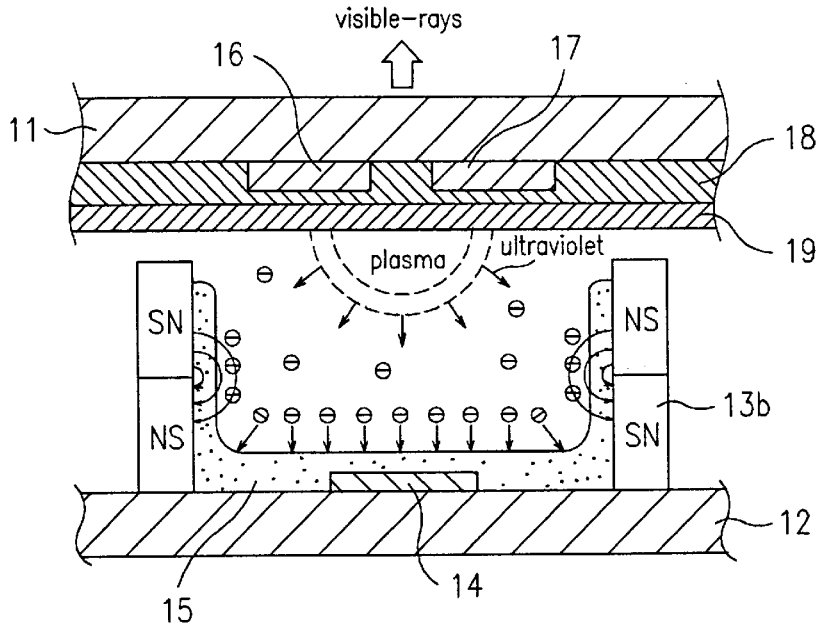
FIG. 6A illustrates a section of a plasma display panel with magnetic partition walls in accordance with a second embodiment of the present invention.
Figure 6B:
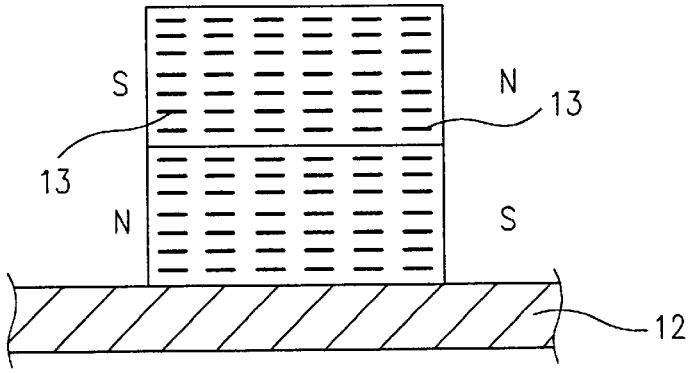
FIG. 6B illustrates detail of the magnetic partition walls shown in FIG. 6A.
Figure 6C:
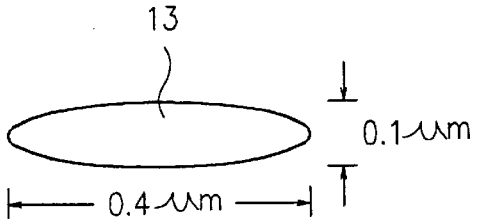
FIG. 6C illustrates a close up view of one of the acicular shaped magnetic particles shown in FIG. 6B.

FIG. 6A illustrates a section of a plasma display panel with magnetic partition walls in accordance with a second embodiment of the present invention, FIG. 6B illustrates detail of the magnetic partition walls shown in FIG. 6A, and FIG. 6C illustrates a close up view of one of the acicular shaped magnetic particles shown in FIG. 6B. Referring to FIG. 6A, the plasma display panel with magnetic partition walls in accordance with the second embodiment of the present invention includes a front substrate 11, a rear substrate 12, partition walls 13*b*, a plurality of first and second sustain electrodes 16 and 17, a plurality of address electrodes 14, a fluorescent material film 15, a dielectric film 18, and a protection film 19, basically identical to the system shown in FIG. 3. Herein, the reference number 13*b* represents a plurality of partition walls disposed on a surface of the rear substrate 12 facing the front substrate 11 at fixed intervals. Each of the partition walls are formed with one pair of permanent magnets. A plurality of discharge cells are formed by coupling the front substrate 11 to the rear substrate 12. Instead of the partition walls 13*a* in the first embodiment, each of the partition walls 13*b* in the second embodiment is formed with one pair of permanent magnets for forming sustained magnetic fields in the discharge cell (the arrows shown in FIG. 6A denote magnetic force lines) to induce an electric field. As shown in FIG. 6A, when a discharge occurs under a state in which the electric field is induced in the discharge cell, discharge gas is ionized into electrons and ions into a plasma state, particles excited by collisions under the plasma state emit ultraviolet rays that drop to a bottom state, and the ultraviolet rays stimulate a fluorescent material film 15 on a portion inside of the discharge cell, causing the fluorescent material film 15 to emit visible light. In this instance, the electric fields induced by the magnetic fields formed in the discharge cell by the partition walls 13*b* accelerate the plurality of electrons existing in the plasma toward the fluorescent material film 15 and stimulate the fluorescent material film 15, leading the fluorescent material film 15 to emit visible light. That is, as can be known from an equation (I) below showing a relation between a wavelength λ of an electron and electric potential V applied thereto, an electron, being a charged particle, has its wavelength λ gradually shortened and its speed accelerated in an electric field, and, as can be known from an equation (II) below showing a relation between a stimulation energy to an electron and a speed of the electron, the stimulation energy becomes greater in proportion to the speed of the electron enough to excite the fluorescent material layer 15.

$$\lambda \cong \sqrt{\frac{150}{V}} \qquad \text{equation (I)}$$

$$\text{Stimulation energy} = \frac{1}{2}V^2 \qquad \text{equation (II)}$$

The principle that the fluorescent material film 14 is stimulated with electrons thus accelerated can be considered similar to the principle that a fluorescent material is stimulated with an electron beam emitted from a CRT to generate visible light. The electron, significantly lighter than an ion, substantially imparts no damage to the fluorescent material film 15. In conclusion, when the ultraviolet rays and the electrons stimulate the fluorescent material film 15 at discharge in each of the discharge cells, as the fluorescent material film 15 is excited to an extent greater than the conventional one, more emission of the visible light occurs and a luminance of each of the discharge cells becomes higher.

THIRD EMBODIMENT

Figure 7:
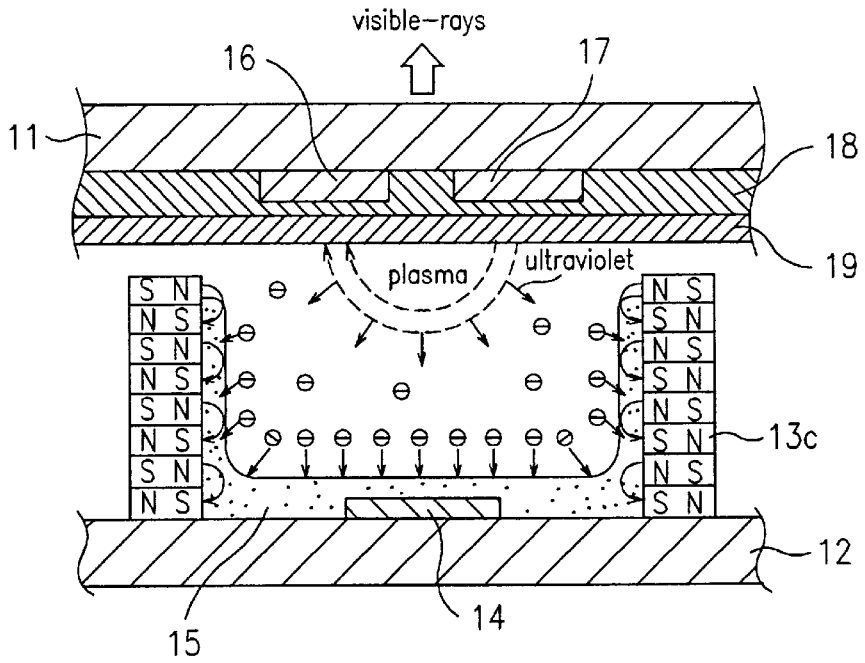
FIG. 7 illustrates a section of a plasma display panel with magnetic partition walls in accordance with a third embodiment of the present invention; and, FIG. 8 illustrates a section of a plasma display panel with magnetic partition walls in accordance with a fourth embodiment of the present invention.

Referring to FIG. 7, the partition walls 13*c* in this third embodiment has 8 permanent magnets for sustained formation of magnetic fields(the solid lines in FIG. 7 denote magnetic force lines) to induce electric fields. When a discharge occurs under a state in which the electric fields are thus induced in the discharge cell, the ultraviolet rays and the electrons accelerated toward the fluorescent material film 15 together excite the fluorescent material film 15 under the same principle as the cases of the first and second embodiments, thereby increasing the luminance of each of the discharge cells.

In the meantime, as has been explained in the first, second and third embodiments, each of the permanent magnets in the partition walls 13*a*, 13*b* and 13*c* has a stack of magnet films containing a plurality of acicular shaped magnet particles 13. That is, if films of a mixture of acicular shaped magnetic material particles and a binder are stacked to form the partition walls 13*a*, 13*b* or 13*c* and an N or S pole of a magnetic body is brought into contact to a side of the partition walls 13*a*, 13*b* or 13*c* (conducted layer by layer), causing the magnetic material particles 13 aligned in a desired magnetizing direction, magnets magnetized into at least a pair of N pole and S poles as shown in FIG. 7 can be obtained. The acicular shaped magnetic material particles are applied for increasing a shape induced-magnetic anisotropy greater than rectangular magnetic particle application, that improves magnetic properties(such as a coercivity). In order to make an intensity of a magnetic field, as shown in FIG. 6C, magnetic material particles having a length of 0.4 μm and a height of 0.1 μm are selected because, when a magnetic effect is utilized, the intensity of a magnetic field from a magnetic body gradually loses its ferromagnetic characteristics if the magnetic material particle has a length below a certain limit(about 100 A) in the case when the magnetic material particle is fixed. Therefore, when the length of the acicular shaped magnetic material particle 13 is below 0.4 μm, there is difficulty in forming a magnetic field.

FOURTH EMBODIMENT

The plasma display panel in accordance with the fourth embodiment of the present invention has the rear substrate of the first, second and third embodiments formed with at least more than one magnet magnetized into a pair of N and S poles. Similar to the permanent magnets explained in connection with the first, second and third embodiments, each of the permanent magnets in the rear substrate of the fourth embodiment also has a stack of magnet films containing a plurality of acicular shaped magnet particles.

Figure 8:
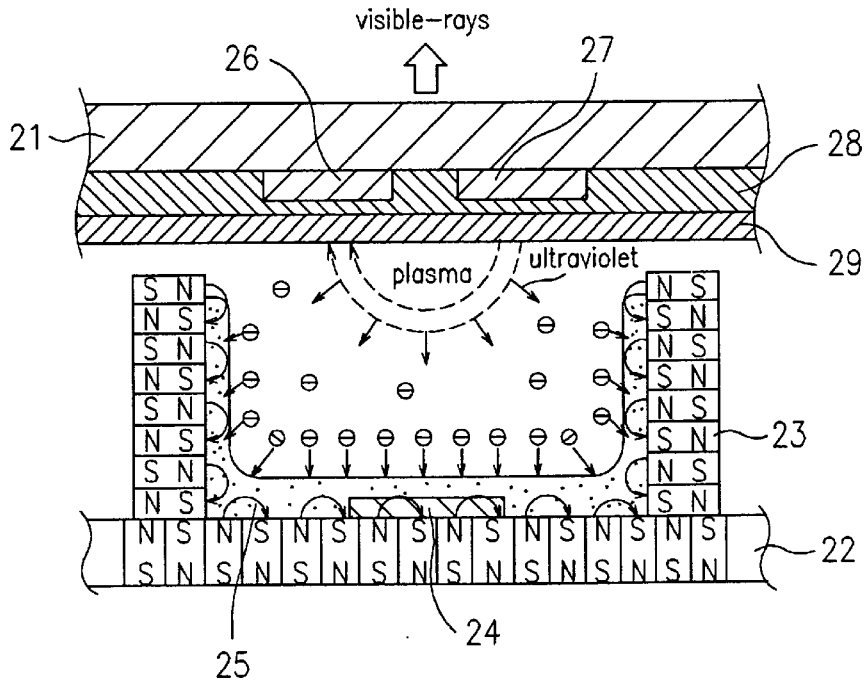

The fourth embodiment of the present invention will be explained with reference to a section of one discharge cell shown in FIG. 8. The front substrate 21, a plurality of address electrodes 24, a fluorescent material film 25, a plurality of first and second sustain electrodes 26 and 27, a dielectric film 28 and a protection film 29 shown in FIG. 8 are identical to the ones explained in connection with conventional art. The reference numbers 22 and 23 shown in FIG. 8 denote the rear substrate 22 and the partition walls 23 both of which are formed with a plurality of permanent magnets each magnetized into pairs of N and S poles. At occurrence of discharge in the discharge cell under the state that the electric fields are induced by the magnetic fields continuously formed by the rear substrate 22 and the partition walls 23 in the discharge cell(the solid lines in FIG. 8 are magnetic force lines) as shown in FIG. 8, similar to the aforementioned first, second and third embodiments of the present invention, the ultraviolet rays and the electrons accelerated toward the fluorescent material film 25 together excite the fluorescent material film 25, thereby improving a luminance of the discharge cell.

In the meantime, though not shown, even if the partition walls are formed with glass as in the conventional art while forming only the rear substrate with permanent magnets as in another embodiment of the present invention, an effect similar to the first to fourth embodiments of the present invention can be obtained.

The plasma display panel with magnetic partition walls and the method for fabrication the same as has been explained has the following advantages.

First, the increased emission of visible lights from each of the discharge cells coming from the fluorescent material film excited both by ultraviolet rays and electrons existing in the discharge cells accelerated toward the fluorescent material film by the magnetic fields formed in the discharge cells continuously permits improvement of a luminance of the entire screen.

Second, the formation of the partition walls by means of sand blasting allows the partition walls to have equal size and the simultaneous magnetization of the partition walls allows to reduce production time and improve productivity because the fabrication is easy.

It will be apparent to those skilled in the art that various modifications and variations can be made in the plasma display panel with magnetic partition walls and the method for fabricating the same of the present invention without departing from the spirit or scope of the invention.

Thus, it is intended that the present invention cover the modifications and variations of this invention provided they come within the scope of the appended claims and their equivalents.

I claim:

1. A plasma display panel comprising:

a plurality of discharge cells formed with a plurality of partition walls, the plurality of partition walls are arranged with fixed intervals therebetween and are arranged between a front substrate and a rear substrate, the rear substrate is disposed in parallel spaced at a certain distance with respect to the front substrate;

a fluorescent material film formed on a portion of an inside surface of each of said plurality of discharge cells; and a discharge gas sealed in each of said plurality of discharge cells, the discharge gas being converted into a plasma upon occurrence of a discharge in said plurality of discharge cells, each of the plurality of partition walls are a stack of at least more than one pair of permanent magnets each magnetized into N and S poles, the N and S poles arranged to alternate in a vertical direction, for creating a magnetic field in said plurality of discharge cells to accelerate electrons in the plasma toward said fluorescent material film upon occurrence of a discharge in said plurality of discharge cells, to excite said fluorescent material film.

2. The plasma display panel as claimed in claim 1, wherein each of the permanent magnets are stacked layers of magnetic films each having a plurality of acicular magnetic particles magnetized such that adjacent poles have opposite polarities.

3. The plasma display panel as claimed in claim 2, wherein each of the plurality of acicular magnetic particles have a length of 0.4 $\mu$m and a height of 0.1 $\mu$m for providing a magnetic field of high intensity.

4. The plasma display panel as claimed in claim 3, wherein each of the stacked layers of magnetic films have a thickness of 100 Å.

5. The plasma display panel as claimed in claim 1, wherein the rear substrate includes a magnetic partition wall having permanent magnets stacked in a longitudinal direction and magnetized into N and S poles for creating a magnetic field in each of said plurality of discharge cells.

6. The plasma display panel as claimed in claim 5, wherein each of the permanent magnets are stacked layers of magnetic films each having a plurality of acicular magnetic particles magnetized such that adjacent poles have opposite polarities.

7. A plasma display panel comprising:

a plurality of discharge cells formed with a plurality of partition walls, the plurality of partition walls are arranged with fixed intervals therebetween and are arranged between a front substrate and a rear substrate, the rear substrate is disposed in parallel spaced at a certain distance with respect to the front substrate;

a fluorescent material film formed on a portion of an inside surface of each of said plurality of discharge cells; and a discharge gas sealed in each of said plurality of discharge cells, the discharge gas being converted into a plasma upon occurrence of a discharge in said plurality of discharge cells, the rear substrate is a stack of at least more than one permanent magnets magnetized into N and S poles for forming a magnetic field in said plurality of discharge cells to accelerate electrons existing in the plasma toward said fluorescent material film upon occurrence of a discharge in said plurality of discharge cells, to excite said fluorescent material film.

8. The plasma display panel as claimed in claim 7, wherein each of the permanent magnets are stacked layers of magnetic films each having a plurality of acicular magnetic particles magnetized such that adjacent poles have opposite polarities.

9. The plasma display panel of claim 1, wherein the fluorescent material film is formed on the rear substrate.

10. The plasma display panel of claim 1, wherein the fluorescent material film is formed on the plurality of partition walls.

11. A display panel comprising:

a first substrate;

a second substrate;

a plurality of partition walls arranged between said first and second substrates forming a plurality of discharge cells;

a discharge gas sealed in the plurality of discharge cells, the discharge gas being converted into plasma upon occurrence of a discharge within the plurality of discharge cells;

a fluorescent material film disposed on said second substrate within each of the plurality of discharge cells, said plurality of partition walls are each a stack of plural permanent magnets for accelerating electrons in the plasma toward said fluorescent material film to excite said fluorescent material film to emit light through said first substrate.

12. The display panel of claim 11, wherein each of the permanent magnets are magnetized to have N and S poles and are stacked layers of magnetic films, each of the magnetic films having a plurality of acicular magnetic particles magnetized such that adjacent poles have opposite polarity.

13. The display panel of claim 12, wherein the acicular magnetic particles have a length of 0.4 $\mu$m and a height of 0.1 $\mu$m.

14. The display panel of claim 13, wherein the stacked layers of magnetic films are each 100 Å.

15. The display panel of claim 11, wherein the second substrate comprises a plurality of permanent magnets.

16. The display panel of claim 11, wherein said fluorescent material film is also disposed on the plurality of partition walls.

17. A method of improving luminance of a plasma discharge cell comprising:

generating an electric discharge within the plasma discharge cell to convert discharge gas within the plasma discharge cell into plasma; and accelerating electrons in the plasma toward a fluorescent material film disposed on a first substrate within the plasma discharge cell, the fluorescent material film emitting light, in a direction opposite a direction of the accelerated electrons, through a second substrate of the plasma discharge cell.

18. The method of improving luminance of a plasma discharge cell of claim 17, wherein the electrons are accelerated by a stack of plural permanent magnets.

19. The method of improving luminance of a plasma discharge cell of claim 18, wherein respective stacks of plural permanent magnets are within partition walls that are formed between the first and second substrates.

20. The method of improving luminance of a plasma discharge cell of claim 18, wherein the stack of plural permanent magnets are within the first substrate.

* * * * *